US005593035A

United States Patent [19]

Taylor et al.

[11] Patent Number: 5,593,035

[45] Date of Patent: Jan. 14, 1997

[54] PROTECTIVE CASE FOR ROLLS OF SHEET MATERIAL

[76] Inventors: Peter M. Taylor, 39 Olivers Lane, Caledon East, Ontario, Canada, L0N 1E0; David G. Roylance, 18 DeRose Ave., Bolton, Ontario, Canada, L7E 1B6

[21] Appl. No.: 613,141

[22] Filed: Mar. 8, 1996

[51] Int. Cl.[6] ..... B65D 85/672

[52] U.S. Cl. ..... 206/397; 206/408; 206/409; 206/402

[58] Field of Search ..... 206/389, 397, 206/398, 402, 408, 409, 413, 414, 415, 416; 242/55.53

[56] References Cited

U.S. PATENT DOCUMENTS 3,843,071 10/1974 Graham ..... 206/408 X
4,444,313 4/1984 Tyson ..... 206/408 X
4,445,645 5/1984 Byer ..... 206/389 X
5,053,811 10/1991 Watabe et al. ..... 206/397 X

*Primary Examiner*—Jacob K. Ackun
*Attorney, Agent, or Firm*—Shoemaker and Mattare Ltd.

[57] ABSTRACT

Apparatus is provided for protecting, transporting and dispensing standard rolls of sheet material having an open center core and an inner end bent to project obliquely into the open core to define a tang. An elongate mandrel is constructed so that it can be inserted into the open center core of a standardized roll. The mandrel end not first inserted has an abutment face for abutting the end of the roll. The mandrel includes a recess for receiving the tang. A housing which can be opened to allow a mandrel to be removed or inserted defines bearing means for the ends of the mandrel. The housing further defines a slot through which the end of a roll of material can be drawn out of the housing. The mandrel includes a cranking device by which it can be rotated.

10 Claims, 2 Drawing Sheets

PROTECTIVE CASE FOR ROLLS OF SHEET MATERIAL

This invention relates generally to the transportation, protection and dispensing of rolls of sheet material, such as coated aluminum, which is easily creased, distorted or scratched when contacting other materials.

BACKGROUND OF THIS INVENTION

In the window-replacement industry, it is common to utilize standardized rolls of thin-gage aluminum, both sides painted. Such rolls are provided by the aluminum manufacturer, with a length of typically 10 to 30 meters and a width of 24 inches.

Many tradesmen simply allow the roll to bounce around in the back of their trucks, while others may wrap the coils up in flexible material (a tarpaulin, etc.). Unfortunately, the delicate nature of the aluminum material, and the fact that it is easily bent in a permanent manner, results in substantial financial loss to the tradesman whenever the coils are exposed in this way.

In view of the foregoing, there is a substantial need for some means by which the coils can be protected against impact during transportation and storage. Preferably, such means would also include structure by which the coil can be paid out, measured to specific widths and transversely cut.

An object of one aspect of this invention is to provide a housing or container which achieves the above goals, and does so in a reliable and inexpensive manner.

GENERAL DESCRIPTION OF THIS INVENTION

Accordingly, this invention provides an apparatus for protecting, transporting and dispensing standardized rolls of sheet material of the kind having an open centre core, and an inner end which is bent sharply inwardly so as to project into the open core and define a tang extending parallel with the axis of the roll, the case comprising:

an elongate mandrel which includes two opposed end structures and an intermediate structure bridging between the end structures, the intermediate structure and one end structure being shaped and sized so as to permit the mandrel to be inserted into the open centre core of a standardized roll from one end thereof, recess means on said intermediate structure for receiving said tang, the other end structure including a part that abuts one end of a standardized roll, thus preventing said other end structure from entering the open centre core, a housing sized to receive, surround and protect the mandrel when the mandrel is inserted into a standardized roll, bearing means mounting said mandrel for rotation with respect to said housing, access means on the housing through which an end of a roll of material on the mandrel can be drawn out of the housing while the mandrel rotates, crank means accessible from outside the housing by which the mandrel can be positively rotated, and protective mens operatively associated with said one end structure to protect the corresponding end of a roll against damage during mandrel rotation.

GENERAL DESCRIPTION OF THE DRAWINGS

One basic embodiment, and several variants, of this invention are illustrated in the accompanying drawings, in which like numerals denote like parts throughout the several views, and in which.

DETAILED DESCRIPTION OF THE DRAWINGS

Figure 2:
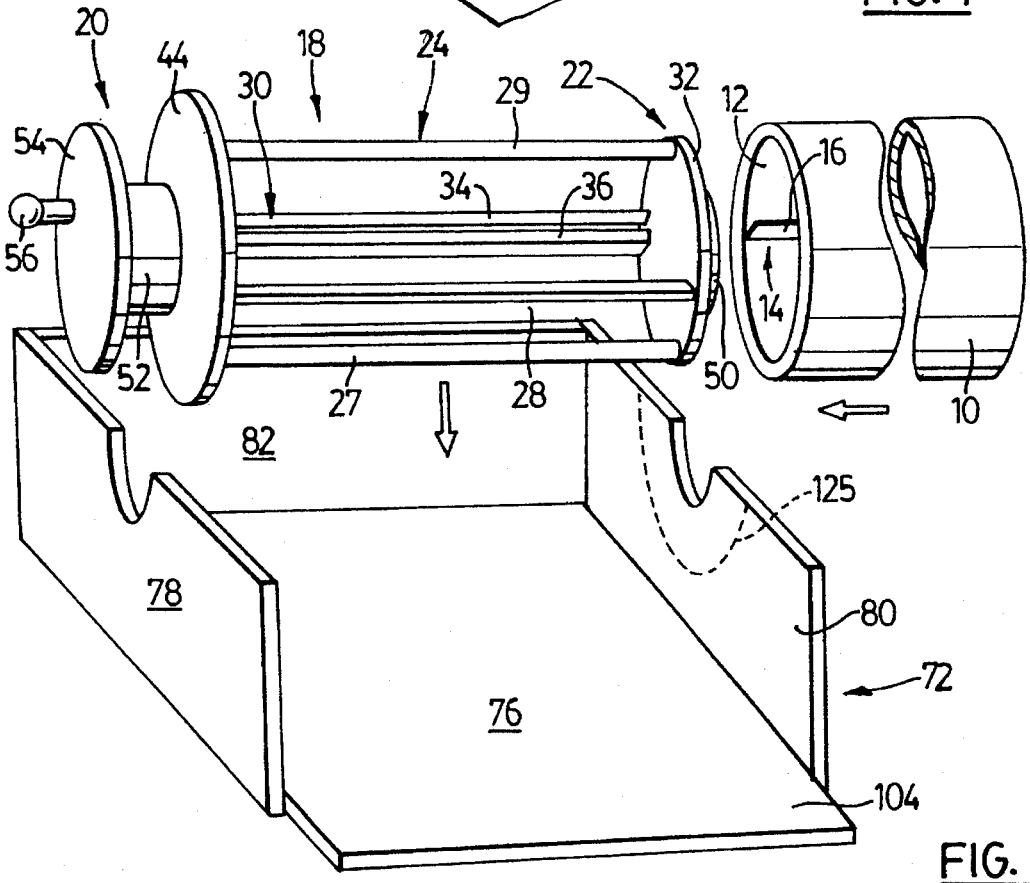
FIG. 2 is a perspective view of one portion of the housing of FIG. 1, showing a mandrel in position to be lowered into a support position, and also showing a coil about to be fitted on the mandrel.

The figures show various aspects of the construction of an apparatus for protecting, transporting, dispensing, measuring and scoring (or cutting) standardized rolls of sheet material, such as the roll shown at 10 in FIG. 2. It will be noted that the coil 10 has an open centre core 12, and an inner end 14 which typically is bent sharply inwardly so as to project obliquely into the open core 12 and define a tang 16 running parallel with the axis of the coil.

Figure 4:
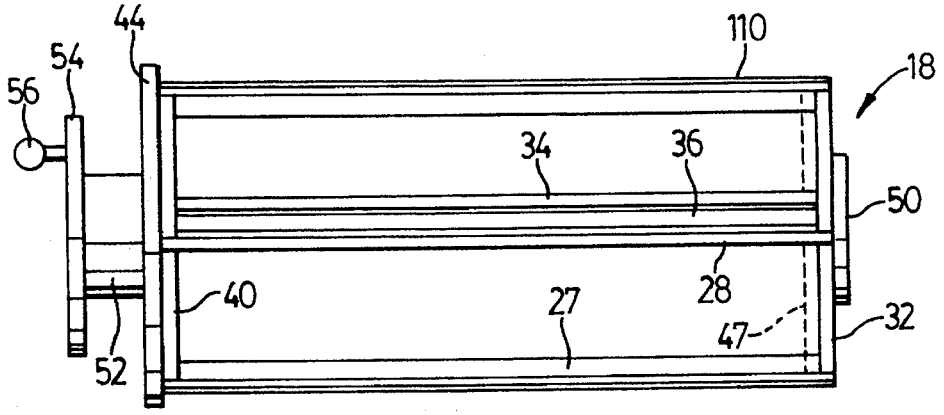
FIG. 4 is a side elevational view of a mandrel constructed in accordance with this invention, and also shows a coil, in axial, longitudinal section, mounted on the mandrel.
Figure 5:
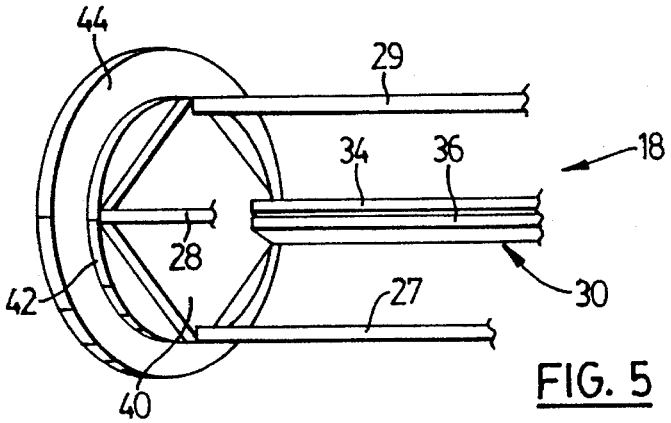
FIG. 5 is a partial perspective view of one end of the mandrel of FIG. 4, showing a variant of the construction.

Attention is first directed to the elongate mandrel, which is shown in FIGS. 2, 4 and 5. The mandrel, generally indicated at 18 includes two opposed end structures 20 and 22, and an intermediate structure 24 bridging between the end structures 20 and 22. The intermediate structure 24 is sized so as to be insertable into the open centre core 12 of a typical roll 10. Further, the end structure 22 is also sized and shaped so as to permit it to pass through the open centre core 12 of a roll, thus allowing the mandrel 18 to be inserted into the open centre core of a roll from one end thereof.

Because an inwardly bend tang 16 is almost always present in the standardized roll, some means must be provided on the mandrel for accommodating the tang, otherwise the mandrel could not be inserted. At the same time, the tang 16 provides a location where the mandrel 18 can grip the roll, for purposes of tightening or loosening the roll. A description of an appropriate means for accommodating the tang 16 is found below.

The other end structure 20 of the mandrel 18 includes a part (44) which abuts the corresponding end of a roll, thus preventing the other end structure 20 from entering the open centre core of the roll.

In the illustrated embodiment, the portion referred to as the intermediate structure 24 includes a plurality of longitudinal, parallel spokes 27, 28, 29 and 30 which extend parallel to each other and bridge the distance between the two opposed end structures 20 and 22. At the right in FIG. 2, the spokes 27–30 lie to the inside of the periphery of a disk member 32, the said periphery of the disk member 32 being small enough to allow it to slide into the open centre core 12 of a roll 10. Since the spokes 27–30 all lie just inside a hypothetical cylinder corresponding to the periphery of the disk 32, they will provide a gentle support for the roll once they have been fully inserted. It will be noted that the spoke 30 is composed of two adjacent spaced-apart portions 34 and 36, the spacing between them constituting a recess means for receiving the tang 16, so as to prevent the inside end of the roll 10 from rotating with respect to the mandrel, once it has been received thereover.

At the other end of the mandrel, as best seen in FIG. 5, the spokes 29–30 remain in a configuration in which they lie just inside a hypothetical cylinder corresponding to the periphery of the disk member 32. At this (leftward) end, FIG. 5 shows the spokes lodged in a substantially rectangular support layer 40 which is secured to a disk 42 corresponding to the hypothetical cylindrical surface, this in turn being secured concentrically to a larger disk 44. FIGS. 4 and 5 show slight variants for the leftward end structure, in that the intermediate disk 42 shown in FIG. 5 is missing in FIG. 4. Instead, the rectangular support layer (slotted at the corners to receive the spokes 27–30) is secured directly against the inner face of the larger disk 44.

At the rightward end of FIG. 4, a structure is shown which is a slight variant of that illustrated in FIG. 2. Specifically, in FIG. 2 the various spokes 27–30 all abut against the smaller disk 32. (to which they can be glued, or otherwise affixed). In FIG. 4, the broken line 47 indicates the optional presence of a supporting rectangular layer similar to the layer 40 in FIG. 5, the layer having comer recesses for receiving the various spokes. If such a rectangular layer is used, however, it is not necessary to have the spokes extend through recesses in the smaller disk 32, since the rectangular support layer would provide an excellent gripping means for the ends of the spokes.

Extending rightwardly from the small disk 32 is a bearing disk 50 which is concentric with the disk 32 and the disk 44.

Returning to the leftward end of the mandrel, and looking simultaneously at FIGS. 2 and 4, it will be seen that there is provided a circularly cylindrical bearing 52 which is concentric with the disk 44, and which extends away from the disk 44 in the direction remote from the disk 32. At the distal end of the bearing 52 is a crank wheel 54 which is secured to the bearing 52 and will rotate as a unit with the entire end structure involving the components 54, 52 and 44.

In the illustrated embodiment, the crank wheel 54 supports an eccentrically mounted, freely turning knob 56 by which the entire mandrel can be rotated. If desired, the knob 56 can be eliminated, and the mandrel can be turned simply by grasping the peripheral edge of the wheel 54 and applying a turning force.

The apparatus of this invention further includes a housing generally shown at 70, the housing including a bottom part 72 (best seen in FIG. 2) and a top part 74, which cooperate together in the following manner.

The bottom part 72 is seen to include a horizontal base wall 76, two upstanding lower end walls 78 and 80 which are contiguous with and securely connected to the base wall 76, and a lower back wall 82 which spans between and is secured to the rearward upright edges of the lower end walls 78 and 80.

Figure 1:
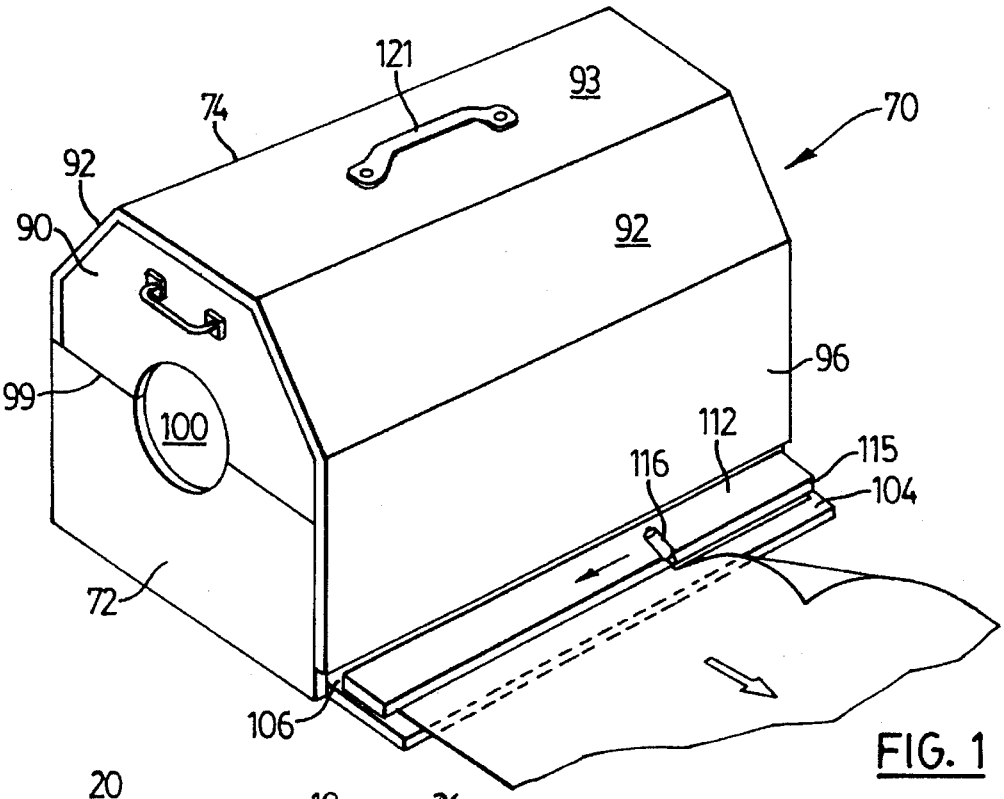
FIG. 1 is a perspective view of a housing constructed in accordance with this invention, showing how coiled sheet material can be dispensed, measured to width, and transversely scored or cut.

The top part of the housing has an upper back wall 84, which is hingedly connected at 86 (see FIG. 3) to the top of the lower back wall 82. The top part also has two upstanding upper end walls 88 (FIG. 3) and 90 (FIG. 1). The top part further includes a plurality of upper protective walls 92, 93 and 94, in the embodiment illustrated (see FIG. 3). Finally, the top part has a front panel 96.

Each pair of aligned lower and upper end walls (for example, the walls 72 and 90 shown in FIG. 1 ) meet along a substantially straight dividing line 99 (which in FIG. 1 is shown to be horizontal), such paired end walls defining semi-circular halves of a circular recess or opening 100 which constitutes a circular bearing seat adapted to receive the respective bearing (either the bearing 52 or the disk 50). Such circular recesses thus constitute bearing means for the apparatus.

Figure 3:
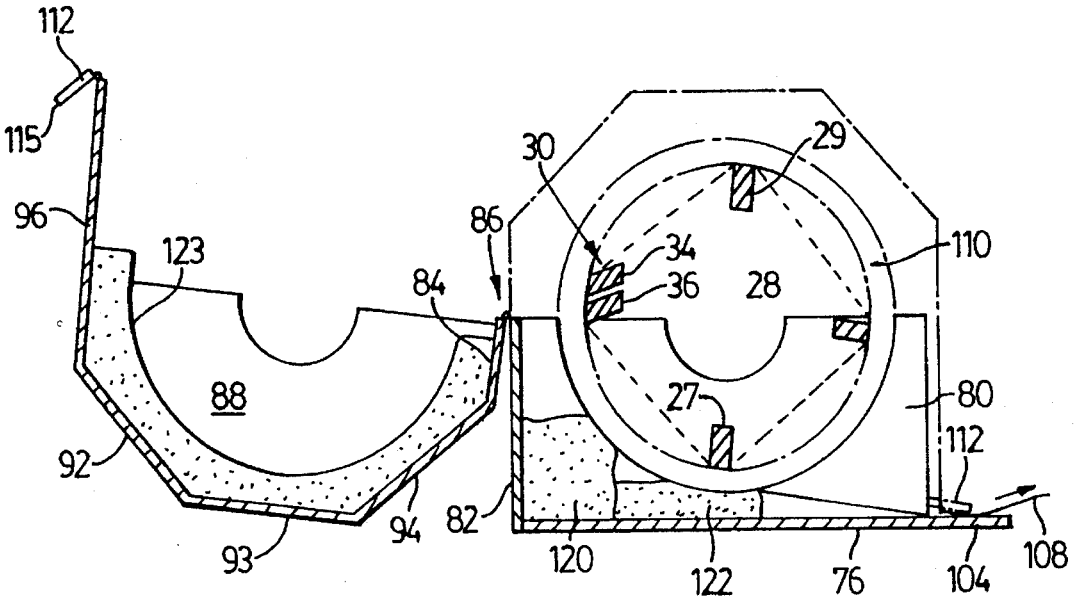
FIG. 3 is a sectional view through the housing, taken at right angles to the axis of the mandrel, showing the apparatus in opened condition.

As best seen by comparing FIGS. 1 and 3, the top part 74 is adapted to pivot with respect to the bottom part, about the hinged connection between the upper back wall 84 and the lower back wall 82 (the hinge being shown at 86). More particularly, the top part is adapted to pivot between (a) an overlying juxtaposition with respect to the bottom, in which a roll or sheet material mounted on the mandrel is substantially completely encircled and shielded from the exterior by the housing 70, and (b) a side-by-side position in which a roll of sheet material on said mandrel is exposed to the exterior, and in which the mandrel can be removed or inserted.

Turning now to FIGS. 1, 2 and 3, it will be seen that the bottom part 72 has nothing constituting a front upstanding wall, and also that the base wall 76 has an anvil portion 104 which extends in the direction away from the lower back wall 82. It is also seen that the top part of the housing, when in the said overlying juxtaposition, defines an elongate slot 106 between the anvil portion 104 and the bottom extremity of the front panel 96, through which slot 106 the leading edge 108 (FIG. 3) of a roll 110 of sheet material mounted on the mandrel 18 can pass. The apparatus further includes a scoring guide 112 which is adjustably mounted, on the front panel 96 of the top pan 74, for movement between an operative position (seen in FIG. 1) in which the scoring guide overlies the anvil portion 104 so that sheet material exiting through the slot 106 passes between the anvil portion and the scoring guide, and an inoperative position in which the scoring guide is spaced away from the anvil portion 104. In the illustrated embodiment, the scoring guide is pivoted by using a piano hinge so that it can be swung up and out of the way, if necessary. The scoring guide 112 defines, along its forward margin, a straightedge 115 allowing the operator to cut or score the sheet material. This is indicated in FIG. 1 by the sketch of a knife 116. It will be understood that, depending upon the material of the coil, the best way to sever the material may be merely to score a line transverse to the sheet material being paid out, and then to bend the material on both sides of the score line repeatedly, until the material simply fails. In other cases it may be expedient to provide a track-controlled cutting or severing mechanism more complex than a simple knife-edge.

In a preferred embodiment, the forward margin of the scoring guide incorporates a measuring strip (which may be stamped directly into the material of the straightedge 115), allowing the operator to measure predtermined widths of the material.

In FIG. 3, the sectional view shows two blocks 120 and 122 and a layer 123 of yieldable foam or similar material, secured in place by gluing or the like, and sized and positioned in such a way as to press gently against the outer convolution of a standardized roll of material, thereby restraining a tendency to unroll, while at the same time applying a transverse force against the roll and mandrel to keep them tightly in place.

Preferably, wax or other similar anti-friction material is used on the bearings 52 and 50.

With regard to the right-hand end structure of the mandrel as illustrated in FIG. 2, it will be realized that the mandrel, when rotating, will cause the corresponding side edges of the flatstock forming the coil to rub frictionally against the inside surface of the end wall 80. To prevent excessive wear, and any tendency for the flatstock to curl or become bent along the edge, a tough but low-friction material may be applied as a thin layer (broken line 125) against the inside face of the wall 80. Alternatively, in a slightly more complex construction, the disk 50 could be elongated so as to be closer in length to the bearing 52 at the other end, and a separable, annular disk could be provided, having an outer diameter greater than that of the disk 32, and an inner diameter sized to fit snugly but slidably over the elongate bearing taking the place of the disk 50. Pegs or the like could be provided in order to keep the attached annular disk from rotating with respect to the disk 32. The housing would then be made slightly longer in the direction of the mandrel axis, in order to accept the additional thickness represented by the separable annular disk. In such a situation, the roll of flatstock would simply turn with the mandrel, without any frictional contact against a non-rotating portion.

It would be a simple matter to allow the mandrel to be rotated from the other end as well (the rightward end in FIG. 4), by providing a crank means to be attached to the disk 50. Such crank means could take the same form as the wheel 54 or the wheel-knob configuration (54, 56) shown at the leftward end in FIG. 4.

It will be seen that the invention set forth herein has a number of advantages. It serves simultaneously as a transportation container, a protector, and a dispenser. Any coiled flatstock can be handled by this apparatus, by conforming to standardized dimensions. It is important to understand that both faces and both end edges of the flatstock forming the coil are protected.

The apparatus of this invention allows the roll to be kept tightly coiled (by the use of tape, for example), so that only factory-clean material will be dispensed.

A further advantage relates to the ease of carrying the housing, for which purpose a central handle 121 can be provided. Alternatively, two side handles 130 can be provided on the walls 90, to allow a two-handed lift (only one seen in FIG. 1).

The housing of the present invention is also fast-loading when used with standardized coils.

Finally, the unit herein described can be placed on any surface without damaging the roll (ground, bench, table, sawhorse, truck tailgate, etc.).

In use, as the operator draws the coiled material out through the slot 106, the mandrel 18 rotates against the restraining friction exerted by the blocks of yieldable material 120, 122, 123. The operator than measures, scores and/or cuts the material as required. When the operator has completed the job, he may then rotate the mandrel 18 in the opposite direction to withdraw any excess material back into the housing, and to take up any slack in the roll (this he can do any time). Removing the slack ensures that factory-fresh material will be available at all times.

Also contemplated, though not illustrated, is the provision of means for manually squeezing the portions 34 and 36 together against a tang located between them. This could be accomplished using an elongate journalled rod lying alongside one of the portions 34, 36 and having an intermedite distortion which presses the adjacent portion (34, 36) inwardly against the tang when the rod is rotated.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege if claimed are defined as follows:

1. An apparatus for protecting, transporting and dispensing standardized rolls of sheet material of the kind having an open centre core, and an inner end which is bent sharply inwardly so as to project into the open core and define a tang transverse to the roll, the apparatus comprising:

an elongate mandrel which includes two opposed end structures and an intermediate structure bridging between the end structures, the intermediate structure and one end structure being shaped and sized so as to permit the mandrel to be inserted into the open centre core of a standardized roll from one end thereof, recess means on said intermediate structure for receiving said tang, the other end structure including a part that abuts one end of a standardized roll, thus preventing said other end structure from entering the open centre core, a housing sized to receive, surround and protect the mandrel when the mandrel is inserted into a standardized roll, bearing means mounting said mandrel for rotation with respect to said housing, access means on the housing through which an end of a roll of material on the mandrel can be drawn out of the housing while the mandrel rotates, crank means accessible from outside the housing by which the mandrel can be positively rotated, and protective mens operatively associated with said one end structure to protect the corresponding end of a roll against damage during mandrel rotation.

2. The apparatus claimed in claim 1, in which said housing has a stationary end wall adjacent each end of the mandrel, the end wall adjacent said one end structure constituting at least a portion of said protective means.

3. The apparatus claimed in claim 2, in which the end wall adjacent said one end structure includes an inner layer of a low-friction material.

4. The apparatus claimed in claim 1, in which said intermediate structure includes a plurality of longitudinal, parallel spokes extending between the opposed end structures, each spoke positioned so as to support the standardized roll from within, one spoke including two adjacent spaced-apart portions constituting said recess means for receiving said tang.

5. The apparatus claimed in claim 4, in which said one end structure defines an opening into the space between said two adjacent portions of said one spoke through which the tang can enter said space.

6. The apparatus claimed in claim 1, in which said part of said other end structure is the inside circular face of an abutment disk disposed transversely to the direction of elongation of the mandrel; said bearing means including a circularly cylindrical bearing secured to said abutment disk and extending coaxially therefrom in the direction remote from said one end structure; said crank means including a component fixed to said cylindrical bearing which can be manually grasped and turned in order to turn the cylindrical bearing and thus the mandrel.

7. The apparatus claimed in claim 6, in which said component includes a crank disk secured coaxially to said cylindrical bearing remote from said abutment disk, the crank disk having a greater diameter than said cylindrical bearing, thus allowing an operator to grasp the edge of the crank disk and use it to rotate the cylindrical bearing and thus the mandrel.

8. The apparatus claimed in claim 6, in which said component includes a crank disk secured coaxially to said cylindrical bearing remote from said abutment disk, the crank disk having a greater diameter than said cylindrical bearing, and a free-turning knob mounted eccentrically to said crank disk, thus allowing an operator to grasp the turning knob and use it to rotate the cylindrical bearing and thus the mandrel.

9. The apparatus claimed in claim 6, in which the housing includes:

1) a bottom part having a horizontal base wall, two upstanding lower end walls contiguous with the base wall, and a lower back wall spanning between the lower end walls, and 2) a top part having an upper back wall hingely connected to said lower back wall, two upstanding upper end walls aligned with said lower end walls, at least one upper protective wall, and a front panel;

each pair of aligned lower and upper end walls meeting along a substantially straight junction line, the two end walls of a pair defining the semi-circular halves of a circular recess constituting a circular bearing seat adapted to receive the respective cylindrical bearing for rotation, thus constituting said bearing means;

said top part being adapted to pivot with respect to said bottom part, about the hinged connection of the upper to the lower back wall, between a) an overlying juxtaposition in which a roll of sheet material mounted on said mandrel is substantially completely shielded from the exterior by the housing, and b) a side-by-side position in which a roll of sheet material on said mandrel is exposed to the exterior, and in which the mandrel can be removed or inserted.

10. The apparatus claimed in claim 9, in which said base wall has an anvil portion extending in the direction away from the lower back wall; in which said top part when in said overlying juxtaposition defines an elongate slot between said anvil portion and a bottom extremity of said front panel, through which slot a leading edge of a roll of sheet material mounted on said mandrel can pass; the apparatus further comprising a scoring guide which is adjustably mounted, on said front panel of the top part, for movement between an operative position in which the scoring guide overlies said anvil portion so that sheet material exiting through the slot passes between the anvil and the scoring guide, and an inoperative position in which the scoring guide is spaced away from said anvil portion, the scoring guide defining a straightedge allowing the operator to cut or score the sheet material.

* * * * *